US008993905B2

(12) United States Patent
Miyasaka et al.

(10) Patent No.: US 8,993,905 B2
(45) Date of Patent: Mar. 31, 2015

(54) STEERING WHEEL MOUNTED SWITCH DEVICE

(71) Applicant: Alps Electric Co., Ltd., Tokyo (JP)

(72) Inventors: Yasuhiro Miyasaka, Miyagi-Ken (JP); Myonsu Kim, Tokyo (JP)

(73) Assignee: Alps Electric Co., Ltd., Tokyo (JP)

( * ) Notice: Subject to any disclaimer, the term of this patent is extended or adjusted under 35 U.S.C. 154(b) by 168 days.

(21) Appl. No.: 13/796,353

(22) Filed: Mar. 12, 2013

(65) Prior Publication Data

US 2014/0102866 A1 Apr. 17, 2014

(30) Foreign Application Priority Data

Mar. 15, 2012 (JP) ..... 2012-059037

(51) Int. Cl.

| | |
|---|---|
| ***H01H 9/00*** | (2006.01) |
| ***H01H 25/06*** | (2006.01) |
| ***H01H 9/26*** | (2006.01) |
| *H01H 13/7065* | (2006.01) |
| *H01H 21/24* | (2006.01) |

(52) U.S. Cl.

CPC ..... *H01H 25/065* (2013.01); *H01H 9/26* (2013.01); *H01H 13/7065* (2013.01); *H01H 21/24* (2013.01); *H01H 2231/026* (2013.01)

USPC ..... 200/61.57; 74/484 R

(58) Field of Classification Search

USPC ..... 200/61.57, 61.54; 74/484 R

See application file for complete search history.

(56) References Cited

U.S. PATENT DOCUMENTS

| | | | | |
|---|---|---|---|---|
| 3,288,946 | A | 11/1966 | Georges | |
| 3,882,294 | A | 5/1975 | Hults | |
| 4,518,836 | A * | 5/1985 | Wooldridge | 200/61.54 |
| 6,225,578 | B1 * | 5/2001 | Kobayashi et al. | 200/5 R |
| 6,525,283 | B2 * | 2/2003 | Leng | 200/339 |
| 2010/0188343 | A1 * | 7/2010 | Bach | 345/173 |
| 2010/0200376 | A1 * | 8/2010 | Takahashi et al. | 200/61.57 |
| 2010/0326229 | A1 * | 12/2010 | Gerharz et al. | 74/492 |
| 2013/0233114 | A1 * | 9/2013 | Matsuo et al. | 74/484 R |

FOREIGN PATENT DOCUMENTS

| | | |
|---|---|---|
| FR | 1427082 | 2/1966 |
| JP | 2000-103300 | 4/2000 |

(Continued)

OTHER PUBLICATIONS

Extended European Search Report issued in corresponding European Patent Application No. 13153413.3, mailed Jun. 21, 2013, 5 pages.

(Continued)

*Primary Examiner* — Vanessa Girardi

(74) *Attorney, Agent, or Firm* — Brinks Gilson & Lione

(57) ABSTRACT

A steering switch device mounted on a spoke portion of a steering wheel allows a first operating knob which can operate to press an operating surface upward obliquely of the front side to be adjacent to a second operating knob which can operate to tilt an operating surface approximately toward the rear of a vehicle. The first and second operating knobs are arranged such that the operating surface and the operating surface of each other are smoothly continuous due to the presence of a minute gap, and are continuous so as to form a surface following the surface entirely from an upper surface (surface opposing a driver) up to a lateral surface (front side surface when viewed from the driver) of the steering wheel.

3 Claims, 6 Drawing Sheets

(56) References Cited

FOREIGN PATENT DOCUMENTS

| | | |
|---|---|---|
| JP | 2006-228620 | 8/2006 |
| JP | 2008-251194 | 10/2008 |
| JP | 2009-205987 | 9/2009 |
| JP | 2009-205987 A | 9/2009 |

OTHER PUBLICATIONS

Office Action issued in Chinese Patent Application No. 201310043482.4, mailed Sep. 29, 2014, 16 pages.

* cited by examiner

STEERING WHEEL MOUNTED SWITCH DEVICE

CLAIM OF PRIORITY

This application claims benefit of Japanese Patent Application No. 2012-059037 filed on Mar. 15, 2012, which is hereby incorporated by reference in its entirety.

BACKGROUND

1. Field of the Disclosure

The present disclosure relates to a steering switch device, which is mounted on a steering wheel of vehicles and used for operating various electronic devices such as audio equipment and an automatic transmission.

2. Description of the Related Art

In the related art, it is known technology where a steering switch device is mounted inside a ring portion (annular portion), which is a grip portion of a steering wheel of a vehicle and then a driver manually perform upshifting or downshifting when travelling in a drive range, by operating the steering switch. Further, the steering wheel is provided with a pad portion inside the grip portion with a spoke portion interposed and thus the steering switch device are often mounted on the spoke portion.

As an example of such a steering switch device in the related art, a device has been proposed in which a plurality of operating keys capable of a pressing operation and an operating body capable of a tilting operation are arranged in the spoke portion of the steering wheel (for example, Japanese Unexamined Patent Application Publication No. 2006-228620). Here, a housing having an opening portion is fixed to the spoke portion and the operating keys or the operating body is arranged and operably supported on the opening portion formed in the housing. In addition, a circuit board or a rubber sheet is accommodated and held inside the housing and the rubber sheet and the circuit board configure a rubber switch. That is, the rubber switch is configured by a movable contact provided inside a bulging portion of the rubber sheet and a fixed contact arranged on the circuit board. The movable contact and the fixed contact oppose each other, leaving a predetermined gap, so as to be capable of connecting and disconnecting.

Each rubber switch is configured such that when the operating keys are in the pressing operation or the operating body is in the tilting operation, the bulging portion of the corresponding rubber switch is thrust and elastically goes through buckling distortion, which causes the movable contact to come into contact with the fixed contact so as to output an ON signal. In addition, if operating force is removed with respect to the operating keys or the operating body, the bulging portion of the rubber switch automatically returns to its original shape due to its elasticity. Accordingly, the movable contact is disconnected from the fixed contact and returns to an OFF state.

Incidentally, vehicles are equipped with various electronic devices which are operated by a driver. However, in recent years, the types of operated electronic devices have increased and increased functionality of the respective electronic devices is also promoted. Accordingly, the need to arrange a plurality of operating knobs (the operating keys or the operating body) around a driver's seat is increasing. Therefore, even in the steering switch device, there is a demand for a structure where many operating knobs can be arranged. However, in the case of the steering switch device mounted on the spoke portion of the steering wheel in the related art, it has been difficult to arrange many operating knobs which are individually incorporated in the opening portion of the housing. That is, the operating knobs operated by a finger of the driver are required to have a necessary size. Attempts to densely arrange the operating knobs simply by miniaturizing may cause impaired operability. Accordingly, it has been difficult to arrange many operating knobs on the spoke portion in the related art.

SUMMARY

A steering switch device is disclosed which is mounted on a spoke portion connecting a ring portion and a pad portion of a steering wheel. The steering switch device has a configuration including a first operating knob arranged at the spoke portion so as to have an operating surface on a front surface side opposing a driver of the spoke portion. A first switch element is driven by the first operating knob and a second operating knob is arranged at the spoke portion so as to have an operating surface on a lateral surface side connecting the front surface and a rear surface opposing the front surface of the spoke portion. A second switch element is driven by the second operating knob. A circuit board is provided on which the first and second switch elements are arranged. A support member is fixed to the steering wheel and supports the first and second operating knobs so as to be respectively operable, and holds the circuit board.

In this manner, the configuration is made such that the first and second operating knobs are respectively arranged at the front surface side and the lateral surface side of the spoke portion so as to have the operating surfaces, the circuit board on which the first and second switch elements are arranged is provided on the support member supporting the first and second operating knob so as to be respectively operable, and the support member is fixed to the steering wheel. Then, it is possible to align many operating knobs in the range operable by the driver's finger grasping the ring portion of the steering wheel. Accordingly, without impairing the operability, it is possible to arrange many operating knobs. In addition, since the first and second operating knobs form a portion of an outer shell member of the spoke portion, the steering switch device with an excellent design can be provided. Furthermore, a simplified configuration and easy manufacturing of the steering switch device can be achieved.

DESCRIPTION OF THE EXEMPLARY EMBODIMENTS

Figure 2:
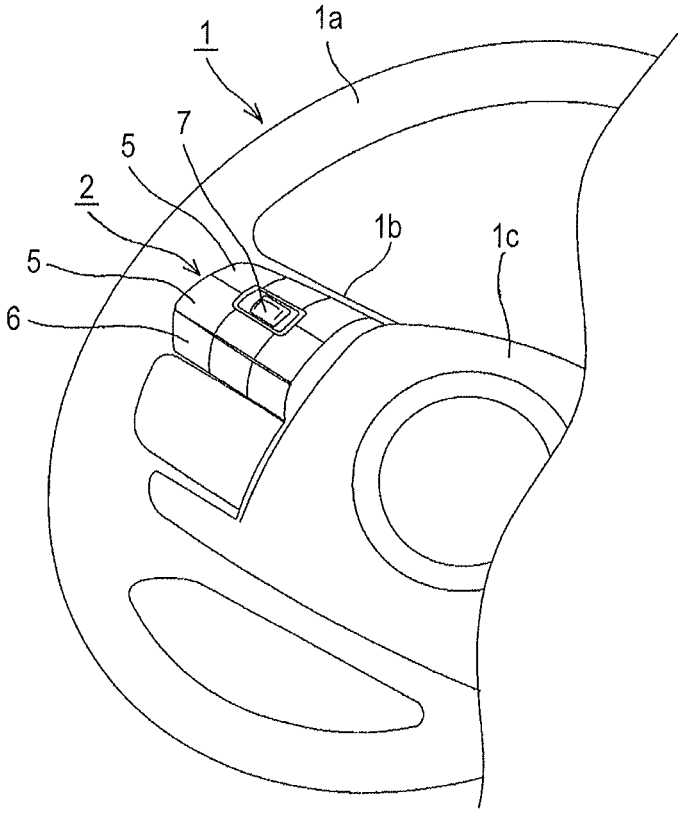
FIG. 2 is a partial perspective view of a steering wheel on which the steering switch device is mounted.

Hereinafter, embodiments of the present invention will be described with reference to the accompanying drawings. As illustrated in FIG. 2, a steering wheel 1 of a vehicle is schematically configured by an annular ring portion 1*a*, a spoke portion 1*b* extended to the inside of the ring portion 1*a*, and a pad portion 1*c* provided in the center portion of the inside of the ring portion 1*a*. A steering switch device 2 according to the embodiment of the present invention is mounted on the spoke portion 1*b* extended to the left side of the pad portion 1*c*. Further, another steering switch device is mounted on the spoke portion extended to the right side of the pad portion 1*c*. However, since this switch device does not directly relate to the present invention, the illustration is omitted.

The steering switch device 2 according to the present embodiment is mainly configured by a support member 3 attached to the spoke portion 1*b* of the steering wheel 1; a circuit board 4 arranged at the support member 3; a plurality of first operating knobs 5 which is supported to be elevatable by the support member 3 and is individually in a pressing operation; a plurality of second operating knobs 6 which is rotatably supported by the support member 3, and is individually pressed and is in a tilting operation; a selective operating knob 7 which is supported to be elevatable and rotatable by the support member 3 via a holder unit 8; a rubber sheet 10 which has a plurality of switch elements and is placed on the circuit board 4; and an actuator 11 interposed between the second operating knobs 6 or the selective operating knob 7 and the rubber sheet 10. Furthermore, the support member 3 is integrally fitted with an upper case 12 and a lower case 13. In addition, the holder unit 8 is configured such that a moving holder 15 is rotatably and pivotally attached to a fixed holder 14. In such a manner that the selective operating knob 7 is supported to be elevatable by the moving holder 15, the selective operating knob 7 can selectively perform the pressing operation and a swing operation.

Figure 3:
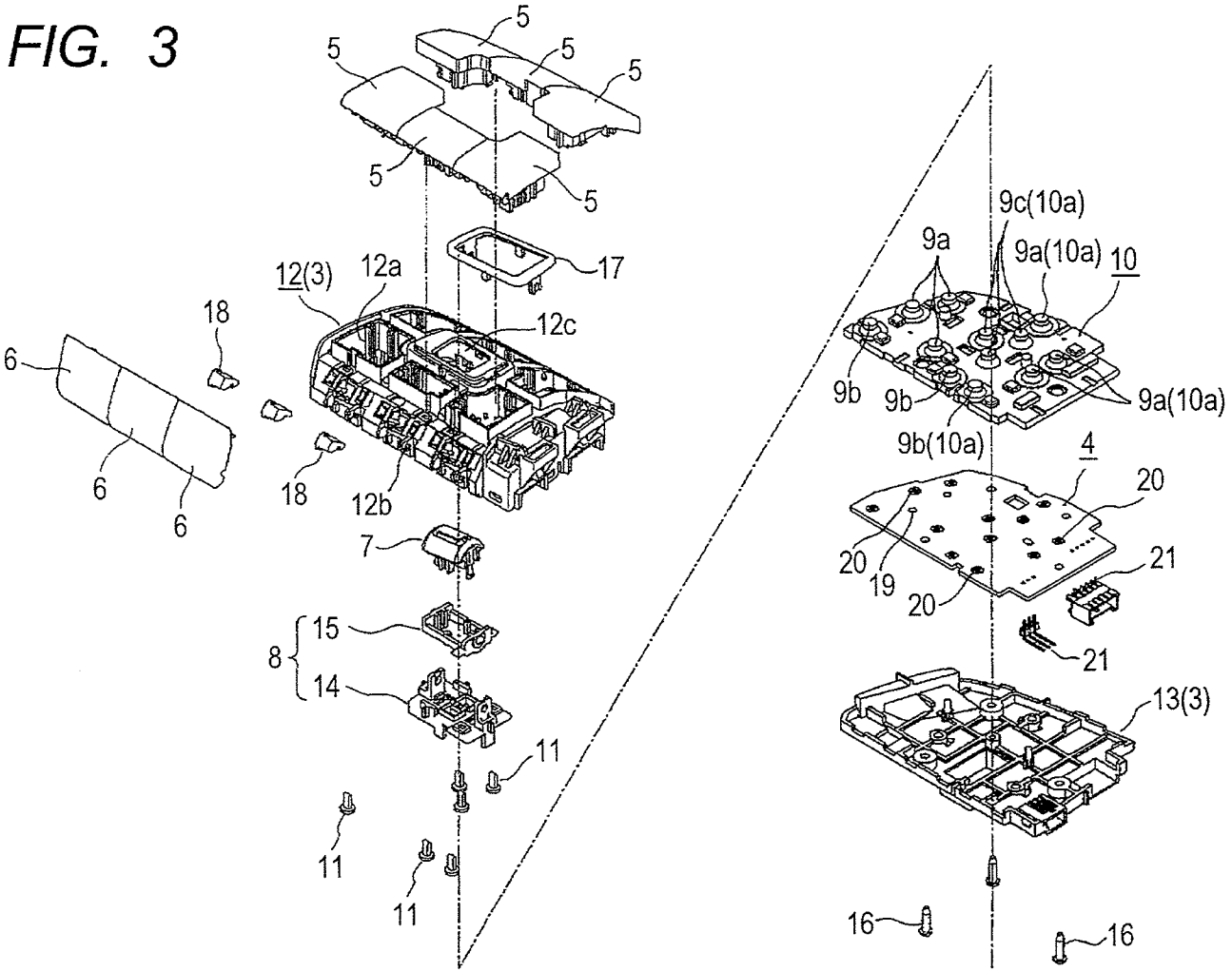
FIG. 3 is an exploded perspective view of the steering switch device.

Any of the upper case 12 and the lower case 13 configuring the support member 3 is a resin molded product. Both of these cases 12 and 13 are fastened and fixed by attaching screws 16 (refer to FIG. 3) in a state of being positioned, and are attached to the spoke portion 1*b*. The upper case 12 includes a guide wall 12*a* supporting the respective first operating knobs 5 to be elevatable; a shaft portion 12*b* pivotally supporting the respective second operating knobs 6 to be tiltable; an opening 12*c* accommodating the selective operating knob 7; and the like. A decorative frame 17 concealing the inside from being seen is attached to the periphery of the opening 12*c*. In addition, light guide bodies 18 are attached to positions of the upper case 12, which oppose the respective second operating knobs 6. Light beams of a light source 19 (refer to FIG. 3) such as an LED can illuminate the rear surface of the second operating knobs 6 via the light guide bodies 18. On the other hand, the circuit board 4 is placed on the lower case 13 and the rubber sheet 10 is placed on the circuit board 4. A laminated body formed by the circuit board 4 and the rubber sheet 10 is accommodated in and fixed to the interior of the support member 3.

Fixed contacts 20 (refer to FIG. 3) are provided on a plurality of positions of the circuit board 4. In addition, connecting terminals 21 for connecting to an external circuit is attached to the circuit board 4. The respective connecting terminals 21 are electrically connected to the corresponding fixed contacts 20 via a wiring pattern (not illustrated).

A plurality of bulging portions 10*a* is protruded on the rubber sheet 10 and a first to third switch elements 9*a*, 9*b* and 9*c* are configured by movable contacts (not illustrated) provided on the inner bottom surface of the bulging portions 10*a* and the fixed contacts 20 on the circuit board 4. That is, the movable contacts of the first to third switch elements 9*a*, 9*b* and 9*c* oppose the corresponding fixed contacts 20 so as to be capable of connecting and disconnecting. Just above the respective switch elements 9*a*, 9*b* and 9*c*, either first drive portions 5*b* (to be described later) of the first operating knobs 5 or actuators 11 are arranged, and the first drive portions 5*b* and the actuators 11 cause the first to third switch elements 9*a*, 9*b* and 9*c* to be in the pressing operation. Specifically, among the bulging portions 10*a* protruded on the rubber sheet 10, the six first switch elements 9*a* are located just below the respective first drive portions 5*b* of the six first operating knobs 5, and the three second switch elements 9*b* are located just below the three actuators 11 driven by the different second operating knobs 6. The three remaining third switch elements 9*c* are located just below the three actuators 11 selectively driven by the selective operating knob 7.

Figure 5:
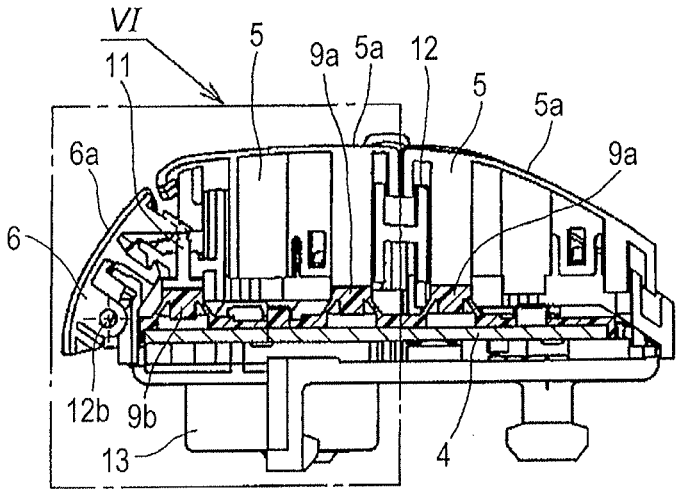
FIG. 5 is a cross-sectional view taken along the line V-V in FIG. 4.
Figure 6:
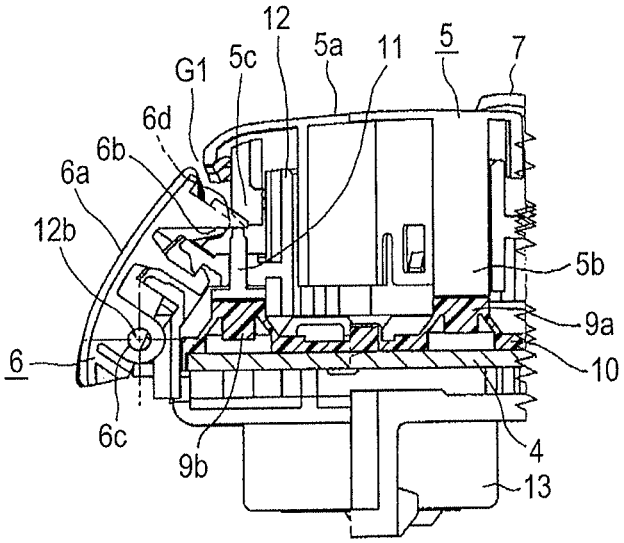
FIG. 6 is an enlarged view of a portion VI in FIG. 5.

As illustrated in FIG. 6, The first operating knobs 5 have the first drive portions 5*b* which are supported by the support member 3 so as to reciprocate in the direction perpendicular to the circuit board 4 and which press the first switch elements 9*a*, when the first operating knobs 5 are in the pressing operation. The actuators 11 are interposed between the second operating knobs 6 and the second switch elements 9*b*. These actuators 11 are supported by the support member 3 so as to reciprocate in the direction perpendicular to the circuit board 4. The second operating knobs 6 have the second drive portions 6*b*, which press the actuators 11 and switch the second switch elements 9*b* when the second operating knobs 6 are in a tilting operation. All of the respective operating knobs 5, 6 and 7 are resin molded products. As is apparent from FIGS. 1, 2 and 5, operating surfaces 5*a* and 6*a* of the first and second operating knobs 5 and 6 are arranged with a slight gap interposed so as to follow the surface of the spoke portion 1*b*).

Furthermore, the selective operating knob 7 is supported by a moving holder 15 of the holder unit 8 so as to be elevatable. Then, the moving holder 15 is pivotally attached to a fixed holder 14 integrally fixed to the upper case 12 from the rear side. Accordingly, the selective operating knob 7 is elevatable with respect to the holder unit 8 and the upper case 12 and is rotatable with respect to the fixed holder 14 and the upper case 12. Therefore, the selective operating knob 7 can selectively perform the pressing operation and the swing operation.

As illustrated in FIG. 6, the first drive portions 5*b* are integrally formed on the first operating knobs 5 in order to drive to press the corresponding first switch elements 9*a*. In addition, a first stopper portion 5*c* is formed on the first operating knob 5 and the first stopper portion 5*c* can be engaged with a second stopper portion 6*d* (to be described later) provided on the adjacent second operating knob 6.

Figure 8:
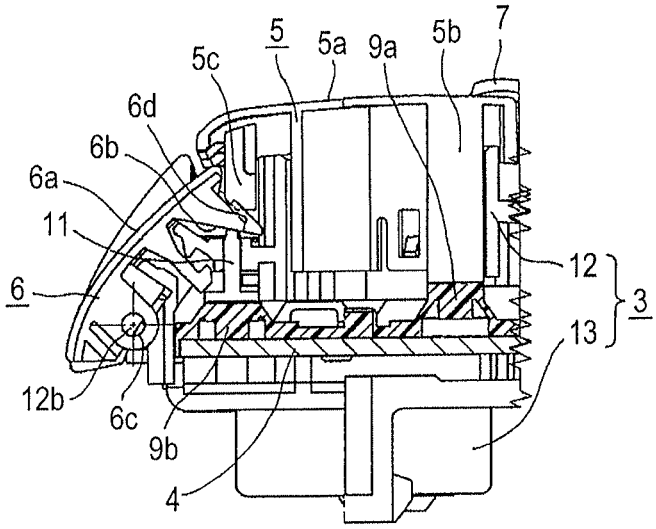
FIG. 8 is an explanatory operation view illustrating a state where a second operating knob in FIG. 6 is in a tilting operation.

On the other hand, as illustrated in FIG. 6, the second operating knob 6 includes a second drive portion 6*b* for driving to press the corresponding actuator 11, a bearing portion 6*c* inserted to the shaft portion 12*b* of the upper case 12, and the second stopper portion 6*d* described above. As illustrated in FIGS. 6 and 8, the bearing portion 6*c* is provided in the vicinity of the lower end portion of the second operating knob 6, that is, in the vicinity of the portion farthest from the adjacent first operating knob 5. The second operating knob 6 is rotatably supported by the upper case 12 as the shaft portion 12*b* inserted to the bearing portion 6*c* is a rotation axis. In addition, the second drive portion 6*b* is provided in the vicinity of the upper end portion of the second operating knob 6, that is, at the side facing a minute gap G1 which is the boundary with the adjacent first operating knob 5, and is always in elastic contact with the upper end portion of the actuator 11 corresponding to the second drive portion 6*b*. In other words, if the vicinity of the upper end portion of the second operating knob 6 is thrust to be tilted, the actuator 11 is pressed down by the second drive portion 6*b* so as to slidably move toward the circuit board 4. The second stopper portion 6*d* is also provided in the vicinity of the upper end portion of the second operating knob 6. When the second operating knob 6 is not operated, the second stopper portion 6*d* is present at the position away from the first stopper portion 5*c* of the adjacent first operating knob 5. Here, when the first operating knob 5 is in the pressing operation, if the second operating knob 6 is in the tilting operation, the first stopper portion 5*c* and the second stopper portion 6*d* are engaged with each other, and prevent the tilting operation of the second operating knob 6. In addition, when the second operating knob 6 is in the tilting operation, if the first operating knob 5 is in the pressing operation, the second stopper portion 6*d* and the first stopper portion 5*c* are engaged with each other, and prevent the pressing operation of the first operating knob 5. That is, if the first operating knob 5 and the second operating knob 6 are operated at the same time, the first and second stopper portions 5*c* and 6*d* interfere with each other and thereby neither one of the operating knobs can be operated.

Figure 1:
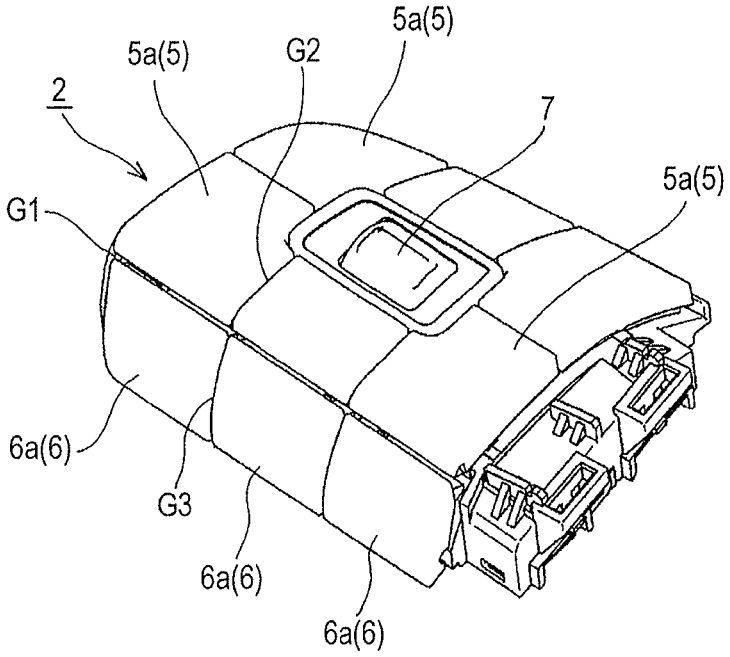
FIG. 1 is a perspective view of a steering switch device according to an embodiment of the present invention.
Figure 4:
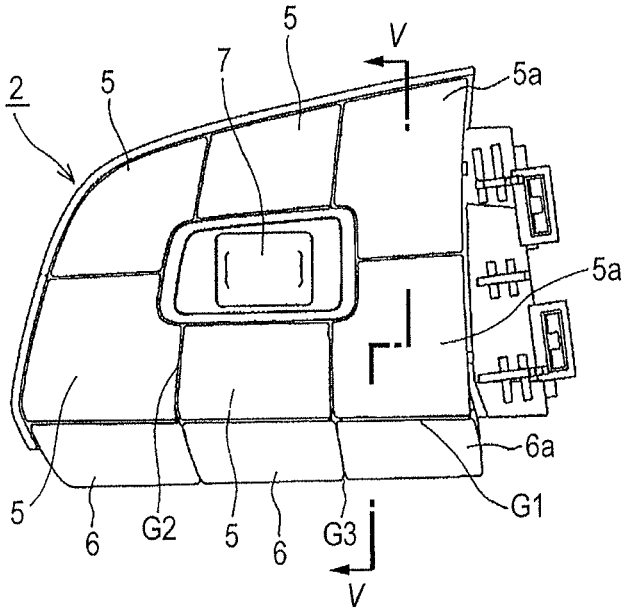
FIG. 4 is a plan view of the steering switch device.

As illustrated in FIG. 6, the first operating knob 5 and the adjacent second operating knob 6 are arranged such that the operating surface 5*a* and the operating surface 6*a* are smoothly continuous with the presence of the minute gap G1 when they are not respectively operated. In addition, as illustrated in FIGS. 1 and 4, each of a plurality of the first operating knobs 5 is also smoothly continuous with the presence of the minute gap G2 and similarly each of a plurality of the second operating knobs 6 is also smoothly continuous with the presence of the minute gap G3. In this manner, the first operating knob 5 and the second operating knob 6 are arranged so as to be in close contact with each other having the minute gap. Therefore, in the steering switch device 2 according to the present embodiment, the first and second operating knobs 5 and 6 form a portion of the outer shell member of the spoke portion 1*b* and thereby the steering switch device 2 with an excellent design may be provide.

Next, an operation of the steering switch device 2 will be described. As illustrated in FIGS. 5 and 6, the first operating knob 5 is pressed up by the first switch element 9*a* on which the first drive portion 5*b* is mounted, being held at the non-operating position, and the operating surface 5*a* faces obliquely upward and can oppose a driver. Accordingly, the movable contact inside the first switch element 9*a* pressing up the first operating knob 5 is away from the opposing fixed contact 20 and the first switch element 9*a* is in a switched off state. In addition, since the corresponding actuator 11 is pressed up by the immediately below positioned second switch element 9*b*, the second operating knob 6 is also held at the non-operating position in a state of being biased in the counterclockwise direction in FIG. 6 via the second drive portion 6*b*. Therefore, the movable contact of the second switch element 9*b* pressing up the second drive portion 6*b* of the second operating knob 6 is away from the opposing fixed contact 20 and the second switch element 9*b* is also in the switched off state.

Furthermore, when both of the adjacent first operating knob 5 and second operating knob 6 are in the non-operating state, as illustrated in FIG. 6, the first stopper portion 5*c* provided on the first operating knob 5 and the second stopper portion 6*d* provided on the second operating knob 6 are located away from each other having the presence of some gap.

Figure 7:
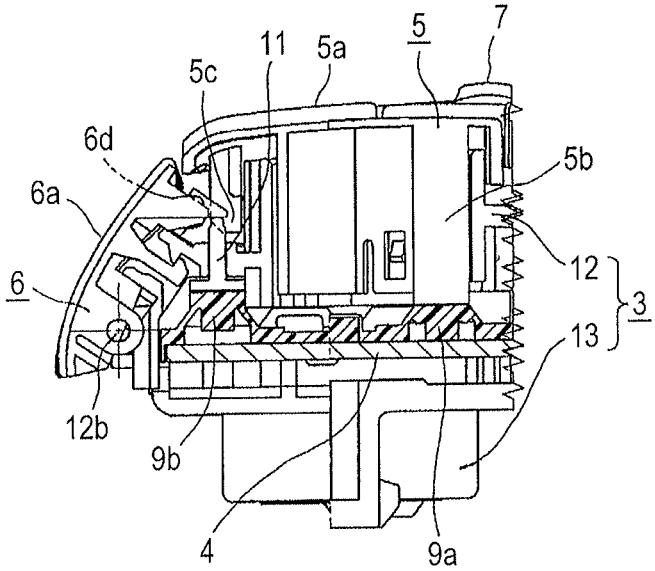
FIG. 7 is an explanatory operation view illustrating a state where a first operating knob in FIG. 6 is in a pressing operation.

If the driver presses any of the first operating knobs 5 downward in this state, as illustrated in FIG. 7, the first drive portion 5*b* of the first operating knob 5 subjected to the pressing operation thrusts the first switch element 9*a* just below and causes the bulging portion 10*a* on which the first switch element 9*a* is provided to elastically go through buckling distortion. Accordingly, the movable contact within the first switch element 9*a* comes into contact with the opposing fixed contact 20 and an ON signal is output from the first switch element 9*a*. Then, a feeling of click is imparted in response to the buckling distortion of the bulging portion 10*a* on which the first switch element 9*a* is provided. Thereafter, if pressing operation force is removed with respect to the first operating knob 5, the bulging portion 10*a* subjected to the buckling distortion automatically returns to its original shape due to its elasticity. Accordingly, the first switch element 9*a* presses the first operating knob 5 upward to the non-operating position via the first drive portion 5*b* and the first switch element 9*a* returns to an OFF state.

On the other hand, if the driver thrusts and tilts the vicinity of the upper end portion of any of the second operating knobs 6, as illustrated in FIG. 8, the second drive portion 6*b* of the second operating knob 6 subjected to the tilting operation presses the corresponding actuator 11 downward. Accordingly, the actuator 11 thrusts the second switch element 9*b* just below and causes the bulging portion 10*a* on which the second switch element 9*b* is provided to elastically go through the buckling distortion. Therefore, the movable contact within the second switch element 9*b* comes into contact with the opposing fixed contact 20 and the ON signal is output from the second switch element 9*b*. Then, the feeling of click is imparted in response to the buckling distortion of the bulging portion 10*a* on which the second switch element 9*ab* is provided. Thereafter, if pressing operation force is removed with respect to the second operating knob 6, the bulging portion 10*a* subjected to the buckling distortion automatically returns to its original shape due to its elasticity. Accordingly, the second switch element 9*b* presses the second drive portion 6*b* upward via the actuator 11, the second operating knob 6 is rotated counterclockwise in FIG. 8, thereby automatically returning to the non-operating position, and the second switch element 9*b* returns to the OFF state.

Furthermore, if the first operating knob 5 is in the pressing operation, as illustrated in FIG. 7, the first stopper portion 5*c* descends to a position interfering with a movement of the adjacent second stopper portion 6*d* of the second operating knob 6. Accordingly, the second operating knob 6 cannot be in the tilting operation. In addition, if the second operating knob 6 is in the tilting operation, as illustrated in FIG. 8, the second stopper portion 6*d* descends to the position interfering with the movement of the adjacent first stopper portion 5*c* of the first operating knob 5. Accordingly, the first operating knob 5 cannot be in the pressing operation. That is, the first operating knob 5 and the second operating knob 6 arranged to be adjacent to each other are configured such that one cannot be operated when the other is operated since the stopper portions 5*c* and 6*d* respectively provided inside thereof interfere with each other.

The selective operating knob 7 is configured to selectively perform the pressing operation which thrusts the center portion thereof downward and the swing operation which thrusts the vicinity of the center portion to slide to the rear or the front. Then, during the pressing operation, the third switch element 9*c* located just below the center portion of the selective operating knob 7 elastically goes through the buckling distortion and during the swing operation, the third switch element 9*c* located at the side obliquely downward from the selective operating knob 7 elastically goes through the buckling distortion. Accordingly, using the driver's three operating methods (the pressing operation, the swing operation to the rear side and the swing operation to the front side), it is possible to selectively bring the movable contact within the three different third switch elements 9*c* into contact with the corresponding fixed contacts 20. That is, the selective operating knobs 7 can output three types of ON signal in response to the operating methods.

As described above, the steering switch device 2 according to the present embodiment is configured by the first operating knob 5 arranged at the spoke portion 1*b* so as to have the operating surface at the front surface side opposing the driver of the spoke portion 1*b*; the first switch element 9*a* driven by the first operating knob 5; the second operating knob 6 arranged at the spoke portion 1*b* so as to have the operating surface at the lateral surface side connecting the front surface and the rear surface opposing the front surface of the spoke portion 1*b*; the second switch element 9*b* driven by the second operating knob 6; the circuit board 4 on which the first and second switch elements 9*a* and 9*b* are arranged; and the support member 3 which is fixed to the steering wheel 1, supports the first and second operating knobs 5 and 6 so as to be respectively operable and holds the circuit board 4. Therefore, it is possible to align many operating knobs in the range operable by the driver's finger grasping the ring portion 1*a* of the steering wheel 1. Accordingly, without impairing the operability, it is possible to arrange many operating knobs. In addition, since the first and second operating knobs 5 and 6 form a portion of the outer shell member of the spoke portion 1*b*, the steering switch device 2 with an excellent design can be provided. Furthermore, a simplified configuration and easy manufacturing of the steering switch device 2 can be achieved.

In addition, in the steering switch device 2 according to the present embodiment, the first operating knob 5 is supported so as to be capable of the pressing operation and the second operating knob 6 is pivotally supported so as to be capable of the tilting operation. Accordingly, the driver can perform both of the pressing operation of the first operating knob 5 and the tilting operation of the second operating knob 6 without any trouble using the fingers grasping the ring portion 1*a*. Therefore, better operability may be easily secured.

In addition, the upper end portion of the second operating knob 6 is configured to be adjacent to the first operating knob 5 by pivotally supporting the vicinity of the lower end portion of the second operating knob 6. Accordingly, the second operating knob 6 is capable of the tilting operation by thrusting the vicinity of the upper end portion. Therefore, the driver grasping the steering wheel 1 can easily operate the first and second operating knobs 5 and 6 by reducing the finger's moving distance. Consequently, the steering switch device 2 with better operability can be provided.

Furthermore, the first operating knob 5 has the first stopper portion 5*c* which engages with the second operating knob 6 and prevents the second operating knob 6 from the tilting operation, when the first operating knob 5 is in the pressing operation, if the second operating knob 6 is in the tilting operation, and the second operating knob 6 has the second stopper 6*d* which engages with the first operating knob 5 and prevents the first operating knob 5 from the pressing operation, when the second operating knob 6 is in the tilting operation, if the first operating knob 5 is in the pressing operation. Accordingly, it is possible to prevent the first operating knob 5 and the second operating knob 6 from being operated at the same time.

In addition, the first and second switch elements 9*a* and 9*b* are configured by the fixed contact 20 formed on the circuit board 4 and the rubber sheet 10 arranged on the circuit board 4. When the first operating knob 5 is in the pressing operation, the first operating knob 5 is supported by the support member 3 so as to reciprocate in the direction perpendicular to the circuit board 4 and has the first drive portion 5*b* pressing the first switch element 9*a*. The actuator 11 is interposed between the second operating knob 6 and the second switch element 9*b*, the actuator 11 is supported by the support member 3 so as to reciprocate in the direction perpendicular to the circuit board 4, and the second operating knob 6 has the second drive portion 6*b* pressing the actuator 11 when the second operating knob 6 is in the tilting operation. Accordingly, the first and second drive portions 5*b* and 6*b* can reliably drive the first and second switch elements 9*a* and 9*b* by operating the first and second operating knobs 5 and 6. Therefore, even using the common circuit board 4, the highly reliable steering switch device 2 can be provided.

Furthermore, in the above-described embodiment, the steering switch device 2 having the six first operating knobs 5, the three second operating knobs 6 and the one selective operating knob 7 has been described. However, the number or the arrangement form of the respective operating knobs can be appropriately selected. In addition, it goes without saying that the present invention can be also applied to another steering switch device omitted in FIG. 2.

It should be understood by those skilled in the art that various modifications, combinations, sub-combinations and alterations may occur depending on design requirements and other factors insofar as they are within the scope of the appended claims of the equivalents thereof.

What is claimed is:

1. A steering switch device mounted on a spoke portion connecting a ring portion and a pad portion of a steering wheel, comprising:

a first operating knob arranged at the spoke portion so as to have an operating surface on a front surface side opposing a driver of the spoke portion;

a first switch element driven by the first operating knob;

a second operating knob arranged at the spoke portion so as to have an operating surface on a lateral surface side connecting the front surface and a rear surface opposing the front surface of the spoke portion;

a second switch element driven by the second operating knob;

a circuit board on which the first and second switch elements are arranged; and a support member which is fixed to the steering wheel, supports the first and second operating knobs so as to be respectively operable, and holds the circuit board, wherein the first operating knob is supported so as to be capable of a pressing operation and the second operating knob is pivotally supported so as to be capable of a tilting operation, and wherein an upper edge of the second operating knob is adjacent to the first operating knob, and is pivotally supported in the vicinity of a lower end portion of the second operating knob.

2. The steering switch device according to claim 1, wherein the first operating knob has a first stopper portion which engages with the second operating knob and prevents the second operating knob from the tilting operation, when the first operating knob is in the pressing operation;

wherein the second operating knob has a second stopper portion which engages with the first operating knob and prevents the first operating knob from the pressing operation, when the second operating knob is in the tilting operation.

3. The steering switch device according to claim 1, wherein the first and second switch elements comprise a fixed contact formed on the circuit board and a rubber sheet arranged on the circuit board, wherein the first operating knob has a first drive portion which is supported by the support member and presses the first switch element so as to reciprocate in the direction perpendicular to the circuit board, when the first operating knob is in the pressing operation, wherein an actuator is interposed between the second operating knob and the second switch element, and the actuator is supported by the support member so as to reciprocate in the direction perpendicular to the circuit board, and wherein the second operating knob has a second drive portion which presses the actuator when the second operating knob is in the tilting operation.

* * * * *